US006200355B1

(12) United States Patent
Gadoury

(10) Patent No.: US 6,200,355 B1
(45) Date of Patent: Mar. 13, 2001

(54) METHODS FOR DEEP SHADE DYEING OF TEXTILE ARTICLES CONTAINING MELAMINE FIBERS

(75) Inventor: Dean R. Gadoury, Asheville, NC (US)

(73) Assignee: BASF Corporation, Mount Olive, NJ (US)

( * ) Notice: Subject to any disclaimer, the term of this patent is extended or adjusted under 35 U.S.C. 154(b) by 0 days.

(21) Appl. No.: 09/467,894

(22) Filed: Dec. 21, 1999

(51) Int. Cl.[7] ..... D06P 1/64

(52) U.S. Cl. ..... 8/578; 8/582; 8/611; 8/673; 8/680; 8/685; 8/920; 8/924; 8/529

(58) Field of Search ..... 8/529, 582, 578, 8/611, 925, 673, 680, 685, 920

(56) References Cited

U.S. PATENT DOCUMENTS

| | | |
|---|---|---|
| 3,012,842 | 12/1961 | Aeberhardt et al. . |
| 3,057,673 | 10/1962 | Mills et al. . |
| 3,116,103 | 12/1963 | Gamlen et al. . |
| 3,124,412 | 3/1964 | Fidell et al. . |
| 3,132,910 | 5/1964 | Corpening . |
| 3,310,362 | 3/1967 | Fiess . |
| 3,421,830 | 1/1969 | Casty et al. . |
| 3,494,718 | 2/1970 | Wilson . |
| 3,551,087 | 12/1970 | Schmidt . |
| 3,770,371 | 11/1973 | Bossard et al. . |
| 3,993,442 | 11/1976 | Economy et al. . |
| 4,001,477 | 1/1977 | Economy et al. . |
| 4,009,995 | 3/1977 | Dressler . |
| 4,121,897 | 10/1978 | Duhnkract et al. . |
| 4,131,422 | 12/1978 | Thomas et al. . |
| 4,145,371 | 3/1979 | Tohyama et al. . |
| 4,562,107 | 12/1985 | Daniels . |
| 4,588,411 | 5/1986 | Scheibli et al. . |
| 4,639,477 | 1/1987 | Cseh et al. . |
| 4,666,455 | 5/1987 | Jost et al. . |
| 4,699,625 | 10/1987 | Jenkins . |
| 4,752,299 | 6/1988 | Annen et al. . |
| 4,841,034 | 6/1989 | Ototake et al. . |
| 4,863,483 | 9/1989 | Donenfeld et al. . |
| 4,888,091 | 12/1989 | Nollen et al. . |
| 4,996,289 | 2/1991 | Berbner et al. . |
| 5,051,110 | 9/1991 | Borrell et al. . |
| 5,084,488 | 1/1992 | Weiser et al. . |
| 5,223,334 | 6/1993 | Green . |
| 5,468,537 | 11/1995 | Brown et al. . |
| 5,582,621 | 12/1996 | Roschger et al. . |
| 5,597,387 | 1/1997 | Bauer et al. . |
| 5,624,466 | 4/1997 | Schindler et al. . |
| 5,830,574 | 11/1998 | Gadoury . |
| 5,837,013 | 11/1998 | Guenther et al. . |
| 5,885,307 | 3/1999 | Gadoury . |

FOREIGN PATENT DOCUMENTS

| | | |
|---|---|---|
| 0 768 423 A2 | 4/1997 | (EP) . |

*Primary Examiner*—Margaret Einsmann
(74) *Attorney, Agent, or Firm*—Nixon & Vanderhye P.C.

(57) ABSTRACT

Methods for the deep shade dyeing of melamine fiber-containing textile articles include bringing an undyed melamine fiber-containing textile article into contact with a dye bath containing a dyestuff and an acid donor at a pH of greater than about 6.0 and an elevated dyeing temperature greater than about 100° C. for a time sufficient to dye the textile article with minimal loss of melamine fibers due to acid hydrolysis. Most preferably, the textile article or articles to be dyed is placed into the dye bath at ambient temperature, and thereafter the dye bath containing the textile article or articles to be dyed is heated to the elevated dyeing temperature, for example, at a rate of between about 0.5 to about 2.0° C. per minute. Suitable dyes include non-complexed acid dyes or acid dyes complexed with a metal (e.g., iron, cobalt, copper, aluminum or any transition metal). Suitable acid donors include butyrolactones, ethylene glycol monoformates and ethylene glycol diformates. The textile article may be formed entirely of melamine fibers or may be in the form of a blend of melamine fiber with at least one other type of fiber (e.g., aramid fibers).

11 Claims, No Drawings

METHODS FOR DEEP SHADE DYEING OF TEXTILE ARTICLES CONTAINING MELAMINE FIBERS

FIELD OF THE INVENTION

The present invention relates generally to dyeing of fiber-containing textile articles. In preferred forms, the present invention relates more specifically to dyeing of textile articles which contain melamine fibers.

BACKGROUND AND SUMMARY OF THE INVENTION

Fibers made from melamine resin are dyeable under conventional disperse dyeing conditions without significantly degrading the fiber properties. In this regard, the melamine fiber content of the melamine fiber-containing articles is not significantly reduced when they are dyed in pH ranges from 4 to 10, unless very high temperatures or prolonged dyeing times are employed.

However, under conventional disperse dyeing conditions it is very difficult to achieve deep shades on articles containing melamine fibers, even with the inclusion of producer-colored companion fibers such as pigmented meta- or para-aramids. Disperse-dyed blend fabrics also show inferior wash and/or light fastness. While deep shades can be achieved using acid dyes at a pH below 4.0, under such conditions, there can be loss of an unacceptable amount of melamine fibers due to acid hydrolysis, particularly at elevated temperatures. Deep shades can also be achieved using acid dyes for the melamine fibers and basic dyes for the aramid fibers. These fabrics formed of a blend of melamine and aramid fibers also show poor crock and wash fastness in deep shades.

Recently, it has been proposed to dye condensation products obtainable by condensation of a mixture comprised of unsubstituted melamine, substituted melamine and hydroxyphenyl compounds with formaldehyde or formaldehyde donor compounds in the form of fibers, yarns threads, wovens, knits or nonwovens, in an aqueous liquor with one or more dyes of the class of azo, anthraquinone, coumarin, methine, azamethine, quinophthalone or nitro dyes. (See U.S. Pat. No. 5,624,466 to Schindler et al, the entire content of which being expressly incorporated hereinto by reference.) Also, it has been proposed to dye articles composed of a blend of melamine and cellulose fibers by the use of dyes which preferentially dye the cellulose fibers and not the melamine fibers so that when such a fiber blend is incorporated into a fabric, a chambray appearance results. (See U.S. Pat. No. 5,830,574 to Gadoury, the entire content of which is expressly incorporated hereinto by reference.)

According to the present invention, articles formed of melamine fibers can be dyed to deep shades with minimal (if any) loss of the melamine fibers due to hydrolysis. More specifically, according to the present invention, melamine fiber-containing articles are dyed to deep shades using a dye bath containing an acid dye in combination with an acid donor. During the dyeing process, the dye bath is slowly lowered to provide maximum exhaustion of the dyes at the higher temperatures employed, while limiting the amount of time the melamine fibers are exposed to the lower pH and higher temperature conditions.

These aspects, and others, will become more clear from the following more detailed description of the preferred exemplary embodiments thereof which follow.

DETAILED DESCRIPTION OF THE INVENTION

The term "melamine" as used herein and in the accompanying claims is meant to refer to the resulting condensation reaction product of a mixture comprised of (i) from 90 to 90.99 mol % of from 30 to 99 mol % melamine and from 1 to 70 mol % of a substituted melamine (e.g., most preferably melamine substituted with hydroxyalkyl groups), and from 0.1 to 10 mol % of a phenol, with formaldehyde or formaldehyde donor compounds in a molar ratio of melamines to formaldehyde within the range from 1:1.15 to 1:4.5. See in this regard, U.S. Pat. Nos. 4,996,289, 5,084,488 and 5,322,915, the entire content of each being expressly incorporated hereinto by reference. The preferred melamine fibers that are employed in the practice of the present invention are BASOFIL® melamine fibers commercially available from BASF Corporation, Enka, N.C.

The textile articles may be formed of only melamine fibers or may be formed of a blend of melamine fibers with at least one other synthetic or natural fiber. Most preferably, the textile articles include blends of melamine fibers with aramid fibers, such as aramid fibers which are the polycondensation reaction produces of iso-terephthalic acid with a meta- or para-phenylenediamine. Such m-aramid and p-aramid fibers are known and commercially available from DuPont as NOMEXO® or KEVLAR® aramid fibers. Blends of melamine fibers and aramid fibers are especially well suited for use in the formation of garments employed in high-temperature environments. Blends of about 30%/70% to about 50%/50%, and most preferably about 40%/60%, melamine fiber to aramid fiber are especially well suited for being dyed in accordance with the present invention.

As noted previously, the present invention is most preferably employed for the purpose of dyeing textile articles. As used herein and in the accompanying claims, the term "textile article" is meant to refer to articles formed of fibers. The textile articles employed in the practice of this invention may thus be dyed in the form of fibers, yarns, slivers, tops and tows, as well as in the form of woven, non-woven or knit fabrics formed of the same. The term "fiber" includes fibers of extreme or indefinite length (filaments) and fibers of short length (staple). The term "yarn" refers to a continuous strand or bundle of fibers. The term "sliver" means a continuous strand of loosely assembled untwisted fibers. The term "top" means a sliver which has been combed to straighten the fibers and remove short fiber. The term "tow" means a large strand of continuous fiber filaments without definite twist collected in a loose, rope-like form held together by crimp.

The textile articles are treated in a dye bath which necessarily contains a dyestuff and an acid donor. As used herein and in the accompanying claims, the term "dyestuff" means any substance which adds color to fibers by absorption into the fiber. Most preferably the dyestuffs employed in the practice of the present invention are non-complexed acid or 1:2 metal complexed acid dyes prepared with chrome, iron, cobalt, copper, aluminum, or any transition metal. Direct dyestuffs typically employed to dye textile articles may also be employed, however.

Specific exemplary acid dyes include the following dyes commercially available by their respective Color Index (C.I.) dyes: Acid Yellow 40; Acid Yellow 79; Acid Yellow 159; Acid Yellow 184; Acid Yellow 204; Acid Yellow 241; Acid Orange 116; Acid Orange 142; Acid Orange 162; Acid Green 104; Acid Green 108; Acid Blue 113; Acid Blue 185; Acid Blue 193; Acid Red 50; Acid Red 52; Acid Red 138; Acid Red 299; Acid Red 362; Acid Violet 90; Acid Black 131:1; Acid Black 132:1; Acid Black 194; Acid Black 52; and Acid Black 172. In addition, the following acid dyes may be used which are available commercially without C.I. numbers: Lanaset Blue 2R; Lanaset Navy R; Lanaset Red G; Lanaset Red 2GA; Lanaset Violet B; Lanaset Brown B;

Burconyl Brick Red AF-3B; Burconyl Rubine AF-GR; Burconyl Orange AF-3R; Burconyl Green AF-B; Burconyl Brilliant Blue AF-R; Burconyl Royal Blue AF-R; Burconyl Brilliant Yellow AF-4G; Erionyl Red A-3G; Erionyl Blue RL 200; and Nylanthrene Brilliant Blue 2RFF.

The acid donor that is employed in the practice of the present invention include those compounds which hydrolyze to alcohol or acid under the conditions of processing.

Preferred acid donor compounds that may be employed in the practice of the present invention include ethyl lactate and diethyl tartrate, γ-butyrolactones, ethylene glycol monoformates, ethylene glycol diformates. These acid donor compounds may be used alone or in combinations of two or more the same. Exemplary acid donors which are commercially available include Sandacid® VS (from Clariant Corporation, Charlotte, N.C.), Phycone® (from American Emulsion, Dalton, Ga), Burco® Acid Donor (from Burlington Chemical, Burlington, N.C.), Buffer ADB (from Clariant Corporation, Charlotte, N.C.), Hipochem AG-45 (from High Point Chemical Corporation, High Point, N.C.), Pomossist AGS (from Piedmont Chemical Industries I LLC, High Point, N.C.).

The acid donor will be present in the dye bath in an amount between about 0.5 grams per liter to about 4.0 grams per liter, and preferably between about 2.0 grams per liter to about 3.0 grams per liter, based on the total volume of the dye bath.

The dye bath is typically prepared at a volume equal to about 15 to 20 times the weight of the textile articles to be dyed. The dye bath containing the dyestuff and the acid donor compound may also include other auxiliary compounds typically employed in the dyeing of textile articles, such as dye leveling agents, alkali, lubricants or other processing chemicals which may include organic carriers, anti-foaming agents, salts and the like.

The textile article or articles is (are) placed in the dye bath solution which is thereafter heated to the desired temperature. Most preferably, the textile articles are placed into the dye bath at ambient temperature (e.g., about 20° C.), and thereafter the dye bath containing the textile article or articles to be dyed is heated to an elevated temperature which is between about 100° C. to about 150° C., and typically between about 110° C. to about 135° C. Most preferably, the dye bath is heated from ambient temperature to the elevated dyeing temperature at a rate of between about 0.5 to about 2.0° C. per minute.

The pH of the dye bath is adjusted so as to be greater than 6.0 and typically less than 10.0. Usually, the dye baths employed in the practice of the present invention will exhibit a pH of between about 6.5 to about 8.0.

The dye bath is maintained at its desired temperature for between about 30 to about 60 minutes. The dye bath is then cooled or emptied and the textile goods thoroughly rinsed with fresh water. The dyed textile goods can then be afterscoured, dried and post-heatset with or without chemical finishes, such as fluorochemcials, silicones, softeners and the like.

The conditions are selected within the ranges specified above so as to minimize loss of melamine fiber due to acid hydrolysis. Thus, the amount of the acid donor compound, pH of the dye bath, temperature of the dye bath and/or residence time are selected within the ranges noted above so as to reduce the loss of melamine fiber. Typically, according to the present invention, no more than 6–7 wt. %, and usually no more than 5 wt. % of dyed melamine fiber, based on the undyed weight of the melamine fiber, is lost by dyeing in accordance with the present invention.

The present invention will be further understood by reference to the following non-limiting examples.

EXAMPLES

In the following examples, unless noted otherwise, the following methods were used to measure the stated properties.

Colorfastness to Laundering: AATCC Test Method 61-1996, Option 2A,

Colorfastness to Laundering, Home and Commercial:

Accelerated.

Colorfastness to Light: AATCC Test Method 16-1998, Option E,

Colorfastness to Light.

Colorfastness to Crocking: AATCC Test Method 8-1996, Colorfastness to

Crocking: AA TCC Crockmeter Method.

Color Measurements: Color measurements were made using a Datacolor

Systems Spectrophotometer generating 1976 CIE LAB (D6500 illuminant, 10 degree observer) values. K/S calculations are found in the color science literature, for example, Billmeyer and M. Saltzman, *Principles of Color Technology*, *2nd Edition* (incorporated hereinto by reference).

Color Fastness Ratings: Color fastness ratings are made and reported using either an AATCC Chromatic Transference Scale, AATCC Gray Scale for Staining or AATCC Gray Scale for Evaluating Color Change.

Melamine Fiber Content Determinations: Relative melamine fiber content measurements of fabrics are measured according to BASF Fibers Research and Development internal Test Method CA-G1011-92 using hot, 90% formic acid.

Example 1A

40/60 Basofil®/p-Aramid Fabric—Buffered Dyeing—Black Shade

An 8.5 once per square yard (oz/yd$^2$) rip-stop fabric of 40% Basofil®/60% producer-colored Kevlar® was scoured and dyed according to the following procedure.

Scouring: 15:1 bath ratio, demineralized water 1.0% Palatex® PC (a lubricating agent available from BASF Textile Chemicals, Charlotte, N.C.)

0.50% Kieralone® Jet B (a low foaming scouring agent available from BASF Textile Chemicals, Charlotte N.C.)

0.50% Multiplus® NB-100 (a lubricating agent available from BASF Textile Chemicals, Charlotte N.C.)

0.5 grams per liter (g/L) Soda Ash

The bath was heated to 70° C. and held at 70° C. for 15 minutes. Samples were rinsed thoroughly in warm and cold water.

Dyeing: 15:1 bath ratio, demineralized water 1.0% Uniperol® NB-SE (anionic leveling agent commercially available from BASF Textile Chemicals, Charlotte, N.C.)

1.5 g/L Sodium Acetate 0.5% Acidol™ Black MS-RL (C.I. Acid Black 194)

(Basofil® melamine fiber is available commercially from BASF Corporation, Mt. Olive, N.J. and Kevlar® aramid fiber from E.I. du Pont de Nemours and Company, Wilmington, Del. Acidol™ dye is available from BASF Textile Chemicals, Charlotte, N.C.)

The bath pH was adjusted to 3.0 with citric acid. The sample was heated by heating the dye bath to 130° C. at 2.0° C./min. and held for 45 minutes. The dye bath was cooled at 1.5° C./minute to 60° C., and the sample removed and rinsed in cool water. The resulting dyed sample was a deep solid black shade with a slight red cast and exhibited a K/S value of 13.16. The level of melamine fiber was measured at 33%, with the undyed original fabric melamine fiber content being measured at 39%.

Example 1B

40/60 Basofil®/p-Aramid Fabric—Acid Donor Dyeing—Black Shade

Fabric samples were scoured as in Example 1A and dyed according to the following:

1.0% Uniperol® NB-SE 0.25 g/L Trisodium Phosphate 2.0 g/L Sandacide® VS (acid donor commercially available from Clariant Corporation, Charlotte, N.C.)

1.0% Acidol™ Black MS-RL

The dye bath pH was not adjusted. The sample was heated by heating the dye bath to 130° C. at 2.0° C./min. and held for 45 minutes. The dye bath was thereafter cooled at 1.5° C./minute to 60° C., and the sample removed and rinsed in cool water. The sample was a deep solid black shade slightly lighter than Example 1A, and exhibited a K/S value of 11.92. The level of melamine fiber was measured at 38%.

Example 2A

40/60 Basofil®/p-Aramid Fabric—Acid Donor Dyeing—Navy Blue Shade

A scoured fabric sample as used in Example 1A is dyed as in Example 1B except the following dyes and concentrations were used:

0.5% Acidol™ Black MS-RL 1.0% Burconyl™ Navy AF-RG (commercially available from Burlington Chemical, Burlington, N.C.)

The sample was given a mild afterscour as follows:

15:1 bath ratio, demineralized water 0.5 g/L Kieralone® TX-199 (a low foaming scouring agent available from BASF Textile Chemicals, Charlotte N.C.)

The bath was heated to 70° C. and held at 70° C. for 20 minutes. The sample was rinsed thoroughly in warm and cold water. The resulting dyed sample was a solid, navy blue shade.

Example 2B

40/60 Basofil®/p-Aramid Fabric—Acid Donor Dyeing—Black Shade

A scoured fabric sample as used in Example 1A is dyed as in Example 2A except the following dyes and concentrations are used:

1.0% Acidol™ Black MS-RL 1.0% Intrazone™ Fast Blue 5RS (C.I. Acid Blue 113, commercially available from Crompton & Knowles Colors Inc., Charlotte, N.C.).

The sample was a dark, solid black shade with a slight red cast.

Example 3

40/60 Basofil®/-Aramid Fabric—Acid Donor Dyeing—Black Shade

A scoured fabric sample as used in Example 1A was dyed as in Example 2A except the following dyes and concentrations and acid donor levels were used:

1.0% Acidol™ Black MS-RL 1.0% Nylon Fast Black BW (commercially available from Crompton & Knowles Colors Inc., Charlotte, N.C.)

3.0 g/L Sandacid® VS

Example 4

40/60 Basofil®/p-Aramid Fabric—Acid Donor Dyeing—Black Shade

A scoured fabric sample as used in Example 1A was dyed according to the following procedures and recipe which is especially suitable for machines with high turbulence such as jet and beam machines.

15:1 bath ratio, demineralized water 1.0% Uniperol® NB-SE 1.0% Palatex® PC 0.4% Multiplus® NB-100

0.25 g/L Trisodium Phosphate 2.4 g/L Sandacid® VS 1.0% Acidol™ Black MS-RL 1.0% Nylon Fast Black BW 0.5% Defoamer NSD (commercially available from Piedmont Chemical Industries, LLC, High Point, N.C.).

The sample was heated to 130° C. at 2.0° C./min. and held for 45 minutes. The dye bath was then cooled at 1.5° C./minute to 60° C., and the sample removed and rinsed in cool water. The sample was afterscoured as in Example 2A except at 60° C. for 15 minutes. The dyed sample was a dark, solid black shade similar to that of Example 3A.

Example 5

40/60 Basofil®/p-Aramid Fabric—Acid Donor Dyeing—Navy Blue Shade

A scoured fabric sample as used in Example 1A was dyed as in Example 4A except the following dyes, concentrations and acid donor levels were used:

0.5% Nylosan™ Navy N-RBL (C.I. Acid Blue 113, commercially available from Clariant Corporation, Charlotte, N.C.)

0.5% Acidol™ Black MS-RL 2.5 g/L Sandacid® VS

The sample was afterscoured as in Example 2A except at 70 C for 15 minutes. The sample was a dark, solid navy blue shade.

Table 1 below shows the color strength (K/S) at wavelengths of maximum absorption and fastness properties of Examples 2A, 2B, 3, 4, and 5. Washfastness ratings are reported for stains on nylon and wool of the multifiber swatch used in the test.

TABLE 1

| Color Strength and Fastness Properties | | | | | | | | |
|---|---|---|---|---|---|---|---|---|
| | | | | | | Xenon Lightfastness | | |
| | K/S | Crocking | | Washing | | 20 | 40 | 60 |
| Example | Value | Wet | Dry | Nylon | Wool | AFUs | AFUs | AFUs |
| 2A | 10.8 | 3–4 | 4 | 4 | 4–5 | 4–5 | 4 | 4 |
| 2B | 14.3 | 4 | 4–5 | 4–5 | 4–5 | 4–5 | 4 | 4 |
| 3 | 12.0 | 3–4 | 4 | 4 | 4–5 | 4–5 | 4–5 | 4 |
| 4 | 11.8 | 4 | 4–5 | 4–5 | 5 | 4–5 | 4 | 4 |
| 5 | 10.1 | 3–4 | 4–5 | 3 | 3–4 | 4–5 | 4 | 4 |

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method for dyeing melamine fiber-containing textile articles comprising bringing an undyed melamine fiber-containing textile article into contact with a dye bath containing a dyestuff and an acid donor which is at least one selected from the group consisting of ethyl lactates, diethyl tartrates, γ-butyrolactones, ethylene qlycol monoformates and ethylene glycol diformates at a pH of between about 6.0 to 10.0, and at an elevated dyeing temperature between about 100° C. to about 150° C. for a time sufficient to dye the textile article with minimal loss of melamine fibers due to acid hydrolysis.

2. The method of claim 1, comprising placing the textile article to be dyed into the dye bath at ambient temperature, and thereafter heating the dye bath containing the textile article or article to be dyed to the elevated dyeing temperature.

3. The method of claim 2, wherein the dye bath is heated at a rate of between about 0.5 to about 2.0° C. per minute.

4. The method of claim 1, wherein the textile article is dyed in the dye bath for between about 30 to about 60 minutes.

5. The method of claim 1, wherein the dyestuff is a non-complexed acid dye or a metal complexed acid dye.

6. The method of claim 1, wherein the acid donor is present in the dye bath in an amount between about 0.5 to about 4.0 grams per liter.

7. The method of claim 1, wherein no more than about 7 wt. % of melamine fiber is lost due to acid hydrolysis, based on the total weight of melamine fiber in the undyed textile article.

8. The method of claim 1, wherein the textile article comprises a blend of melamine fibers and aramid fibers.

9. The method of claim 8, wherein the blend is between about 30%/70% to about 50%/50% melamine fiber to aramid fiber.

10. The method of claim 8, wherein the blend is between about 40%/60% melamine fiber to aramid fiber.

11. The method of claim 5, wherein the dyestuff is a metal complexed acid dye which is complexed with chrome, iron, cobalt, copper, aluminum or a transition metal.

* * * * *